US009303950B2

(12) United States Patent
Fuller

(10) Patent No.: US 9,303,950 B2
(45) Date of Patent: Apr. 5, 2016

(54) LOCKABLE CUT-RESISTANT CASE

(76) Inventor: David D. Fuller, Laguna Niguel, CA (US)

( * ) Notice: Subject to any disclaimer, the term of this patent is extended or adjusted under 35 U.S.C. 154(b) by 784 days.

(21) Appl. No.: 13/105,847

(22) Filed: May 11, 2011

(65) Prior Publication Data

US 2011/0278288 A1 Nov. 17, 2011

Related U.S. Application Data

(60) Provisional application No. 61/334,064, filed on May 12, 2010.

(51) Int. Cl.

| | |
|---|---|
| ***F41C 33/06*** | (2006.01) |
| *F41H 5/04* | (2006.01) |
| *A44B 19/30* | (2006.01) |
| *A45C 13/10* | (2006.01) |
| *E05B 67/00* | (2006.01) |

(52) U.S. Cl.

CPC ..... *F41C 33/06* (2013.01); *A44B 19/30* (2013.01); *A45C 13/10* (2013.01); *E05B 67/003* (2013.01); *F41H 5/04* (2013.01)

(58) Field of Classification Search

USPC ..... 190/101; 206/315.11; 70/68

See application file for complete search history.

(56) References Cited

U.S. PATENT DOCUMENTS

| | | | | | |
|---|---|---|---|---|---|
| 690,854 | A | * | 1/1902 | Grant | 383/103 |
| 1,354,581 | A | * | 10/1920 | Sheppard | 383/86.2 |
| 1,803,217 | A | * | 4/1931 | Strayer | A45C 1/10 383/5 |
| 1,819,349 | A | * | 8/1931 | Walrath | 70/68 |
| 1,856,837 | A | * | 5/1932 | Kip | A63B 55/02 206/315.5 |
| 1,889,860 | A | * | 12/1932 | Halpin | 70/68 |
| 2,112,795 | A | * | 3/1938 | Strayer | 70/68 |
| 2,115,993 | A | * | 5/1938 | Kranhold | 281/29 |
| 2,128,689 | A | * | 8/1938 | Bingham | 383/41 |
| 2,574,730 | A | * | 11/1951 | Crew et al. | 206/317 |
| 3,637,000 | A | * | 1/1972 | Walger et al. | 383/61.3 |
| D247,930 | S | * | 5/1978 | Glaser | D3/245 |
| 4,175,604 | A | * | 11/1979 | Bonner | B65D 33/34 383/120 |
| 4,475,247 | A | * | 10/1984 | Lee | 2/2.5 |
| D283,269 | S | | 4/1986 | Durbin | |
| 4,733,840 | A | * | 3/1988 | D'Amore | 248/205.3 |
| 5,050,836 | A | * | 9/1991 | Makous | 248/553 |
| D320,306 | S | * | 10/1991 | Schwartz | D3/289 |
| 5,431,970 | A | * | 7/1995 | Broun et al. | 428/36.5 |
| D404,914 | S | | 2/1999 | Revels | |
| 6,009,996 | A | * | 1/2000 | Purdy | 206/317 |
| 6,233,782 | B1 | * | 5/2001 | Regele et al. | 16/2.1 |
| 6,570,501 | B2 | | 5/2003 | Bushnell et al. | |
| D542,539 | S | * | 5/2007 | Gonzalez | D3/322 |
| D582,680 | S | * | 12/2008 | Gonzalez | D3/324 |

(Continued)

*Primary Examiner* — Tri Mai

(74) *Attorney, Agent, or Firm* — Clay McGurk; The Law Office of Clay McGurk

(57) ABSTRACT

A light-weight case is provided that is cut-resistant, fire-resistant and/or water-proof and that can be easily locked and fasten to stationary objects. The exterior of the case is substantially cut-resistant, while the interior layers can be layers that are fire-resistant, water-proof, any type of padding or nylon for protecting the objects stored in the case. To protect the case from being stolen, a steel cable is threaded through a hole formed by two concentrically aligned grommets and locked to or around a stationary object. The cases include a Global Positioning System (GPS) transmitter that is able to track the location of the case if the case happens to be lost or stolen. The case can be sized and shaped to hold any type of valuable objects, such as guns, jewelry and money.

2 Claims, 9 Drawing Sheets

(56) References Cited

U.S. PATENT DOCUMENTS

| | | | | | |
|---|---|---|---|---|---|
| D583,559 | S | * | 12/2008 | Gonzalez | D3/243 |
| D583,680 | S | * | 12/2008 | Berman | D9/707 |
| 7,905,350 | B2 | | 3/2011 | Wood et al. | |
| 8,006,604 | B2 | * | 8/2011 | Camp | 89/36.01 |
| 8,499,804 | B2 | * | 8/2013 | Schulte | 150/102 |
| 2003/0057122 | A1 | | 3/2003 | Bushnell et al. | |
| 2005/0257678 | A1 | * | 11/2005 | Camp | 89/36.07 |
| 2007/0228091 | A1 | * | 10/2007 | Shawen | 224/153 |
| 2009/0159597 | A1 | * | 6/2009 | Alexander et al. | 220/520 |
| 2009/0190865 | A1 | * | 7/2009 | Chang | 383/110 |
| 2009/0283183 | A1 | * | 11/2009 | Golan | 150/104 |
| 2011/0097021 | A1 | * | 4/2011 | Curran et al. | 383/109 |
| 2011/0142375 | A1 | * | 6/2011 | Lebow | B65D 55/145 383/64 |
| 2012/0152776 | A1 | * | 6/2012 | Camp | 206/317 |

* cited by examiner

LOCKABLE CUT-RESISTANT CASE

BACKGROUND OF THE INVENTION

Cases are used for transporting and protecting a variety of valuable objects, such as guns, rifles, pistols, computers, cell phones, cameras, portable media players, jewelry, money, clothes and passports, for example. These cases can either have a soft shell or a hard shell. Typical soft cases are made from nylon or canvas, are flexible and lightweight, and are opened and closed via a zipper or a flap with Velcro attached thereto. Hard cases are made from some type of hard plastic or metal such as aluminum. Hard cases are normally bulky, difficult to transport and store due to their size and weight, are hard to fit into tight spaces, and can be expensive.

One of the problems with soft cases and hard cases is their vulnerability to the theft of the objects contained inside the case. In some instances, soft and hard cases may be able to be locked. Although locked, soft nylon or canvas cases can usually be cut with a sharp, jagged-edge type of knife to reveal the contents of the case. Some hard cases may be pried apart at the joints or hinges. Therefore what is needed is a flexible, light-weight case that is not susceptible to cutting or prying.

One of the other problems with current soft cases and hard cases is their vulnerability to the theft of a case itself when being transported in a vehicle. There is no easy way for attaching the case to an immovable or stationary part of the vehicle so as to prevent the case from being stolen when the vehicle is burglarized. Therefore what is needed is a soft case that is easily attachable to a stationary part of a vehicle, such as an immovable hook in the trunk of a vehicle or to a base of a vehicle seat, for example.

Another problems with the current cases occurs when the case is stolen. It is impossible to locate the case. Therefore what is needed is a soft case that is easily tracked when it is stolen or misplaced.

In view of the prior art described above, there continues to be a need for a case that is flexible and portable, is easily locked and opened, is able to be securely fastened to stationary objects when being transported, and is cut-resistant, fire-resistant and/or water-proof, and is easily tracked when missing or stolen.

BRIEF SUMMARY OF THE INVENTION

In the preferred embodiment, this invention provides a light-weight, cut-resistant, fire-resistant and/or water-proof case that is easily locked and fastenable to stationary objects. These soft cases contain a Global Positioning System (GPS) transmitter that is able to track the location of the case. The case can hold such items as guns, pistols, rifles, computers, netbooks, cell phones, cameras, jewelry, money, watches, valuable documents, birth certificates, passports, military secrets, company secrets and gadgets, and any other confidential material or item where the safe keeping of the item is paramount.

Thieves would be greatly deterred in stealing such cases because of the triple protection provided by these cases. First, it is nearly impossible for thieves to cut through the impregnable soft shell of the case and get the items stored inside due to the cut-resistant fabric. Second, the cases are easily attachable to stationary objects via a steel cable making it virtually impossible for the thieves to cut the steel cable and steal the cases. Third, these cases can be easily tracked using a GPS transmitter. Therefore, if the case was stolen because it was not attached to a stationary object, the case could easily be tracked and located using the GPS transmitter.

In the preferred embodiment, a case comprises a body formed of a substantially cut-resistant fabric, the body being sized and shaped to fold along a central fold line. A zipper having a pull tab fastens to opposing edges of the body to enable complete closure of the body when the body is folded. A first grommet is fastened to the body at a first position and a second grommet is fastened to the body at a second position. The holes of the first and second grommets concentrically align when the body is folded. A lock is located at one end of the zipper, the lock being able to securely hold the zipper and pull tab when in a locked position. The case also can comprise a GPS transmitter for tracking the location of the case.

An object of the present invention is to provide a flexible, light-weight, cut-resistant case that fits around an object to protect it from scratches, mud, snow and dust.

Another object of the present invention is to provide a flexible cut-resistant case that can easily and quickly be attached to a stationary object.

Yet another object of the present invention is to provide an easy way to track and locate a missing or stolen case.

Another object of the present invention is to provide a cut-resistant, fire-resistant and water-proof case that can keep objects safe, dry and not burned.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed and not to limit it.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE INVENTION

Figure 1:
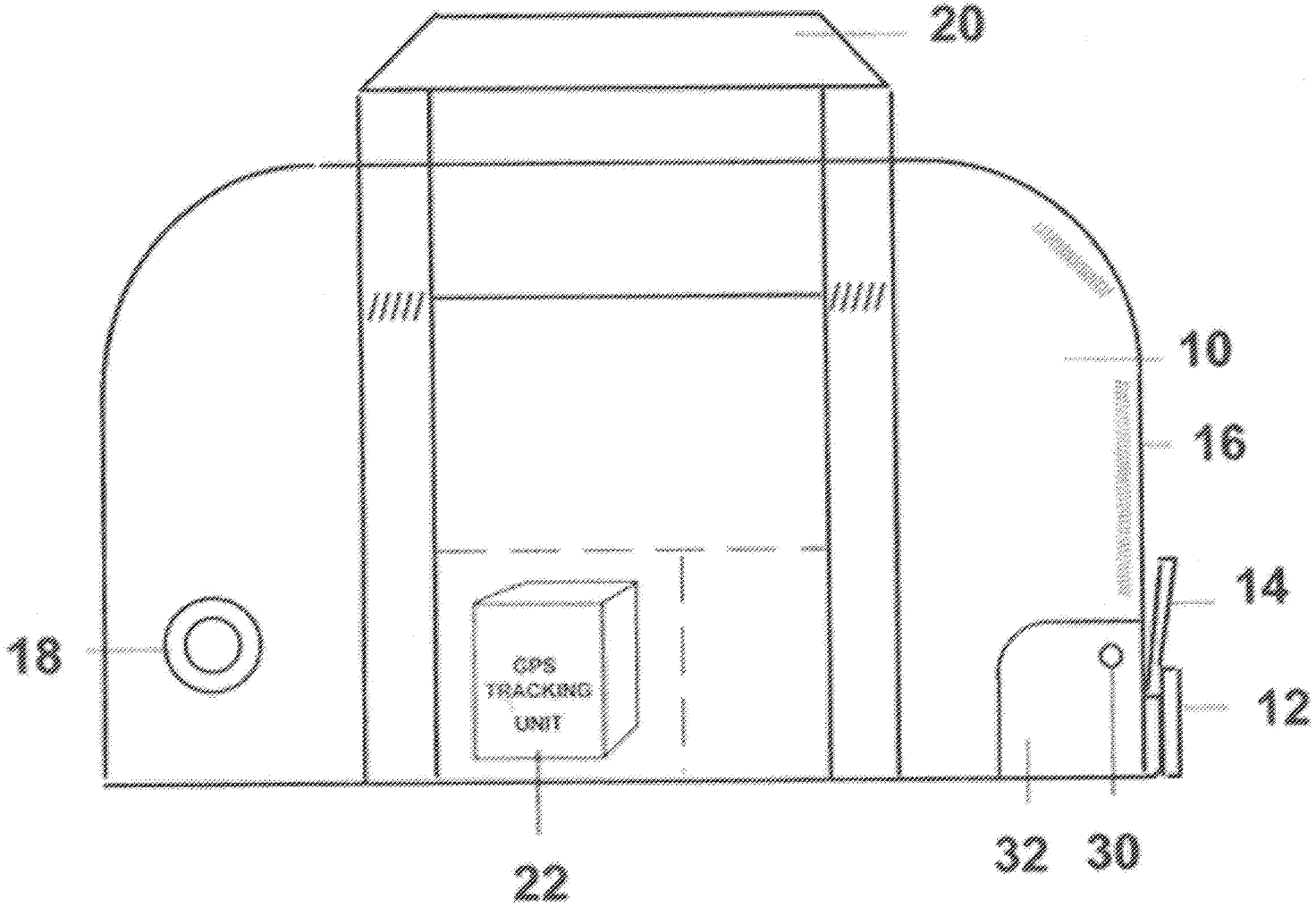
FIG. 1 illustrates a two-dimensional view of a soft case according to a embodiment of the present invention.

FIG. 1 illustrates a two-dimensional view of a soft, flexible case 10 according to a preferred embodiment of the present invention. As shown in FIG. 1, case 10 comprises body of the case 11, lock 12, pull tab 14, zipper 16, a pair of grommets 18 and handle 20. Although case 10 is shaped and sized as shown in FIG. 1, it will be appreciated that case 10 can have any shape and size, including for example, rectangular, square, circular, curved, or any another shape and size that would be able to hold a particular object. Case 10 may also be a backpack having one or more straps suitable for carrying over a person's shoulder. Case 10 can have any shape and size to hold such items as guns, pistols, rifles, computers, netbooks, cell phones, cameras, jewelry, money, watches, valuable documents, birth certificates, passports, military secrets, company secrets and gadgets.

The material that is used to form the outside shell of the body 11 of case 10 comprises commercially available cut-resistant material 13, such as ultra-high molecular weight polyethylene, high tenacity high modulus polyethylene, fiber woven Kevlar, DSM's Dyneema, Honeywell's Gold Flex and Spectra, Teijin Twaron's Twaron, Pinnacle Armor's Dragon Skin, Toyobo's Zylon, or Tuff-n-Lite. It will be appreciated that some of these fabrics provide some level of protection against bullets and are thus resistant to bullets. These types of material are soft, flexible, lightweight and substantially impregnable.

Figure 2:
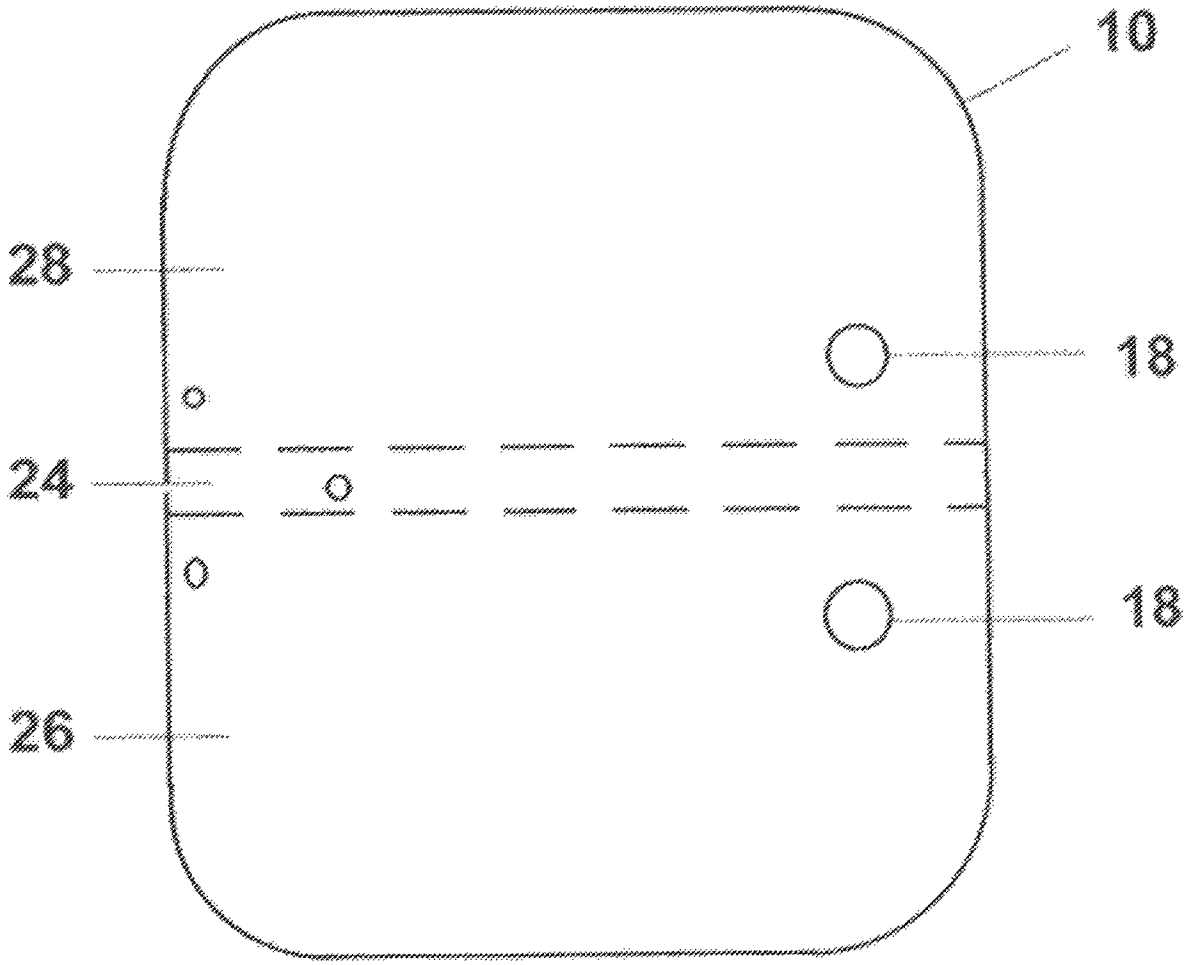
FIG. 2 illustrates a two-dimensional view of an open case according to an embodiment of the present invention.

The exterior of the body 11 of case 10 is preferably made from one piece of cut-resistant fabric 13 such as shown in FIG. 2. A double stitched seam 24 is sewn down the middle of the case 10, so as to create a space between left side 26 and right side 28 when case 10 is folded or closed. It will be appreciated that a single seam could also be used.

Case 10 has an exterior side and an interior side. The interior of case 10 be padded with one or more layers and lined with regular nylon, and can optionally have pockets of any size, shape and configuration. Although it is preferable to have a single layer of cut-resistant fabric on the shell or exterior of case 10, so as to maintain its flexibility, in alternative embodiments, case 10 may have multiple layers of cut-resistant fabric. These multiple layers provide extra protection against cutting and prying to protect the most valuable of objects.

Case 10 may be padded or non-padded. If case 10 was not padded, the cut-resistant material would be the same material, where one side of the cut-resistant fabric would be on the exterior and the other side of the fabric would comprise the interior part of case 10. If case 10 was padded, case 10 would be layered so that the cut-resistant material would be on the exterior, layered next with foam padding (made of foam or other similar type of material), and then a layer of a ballistic nylon or other type of material on the interior of the case. Having a cheaper nylon on the interior saves on the cost of the materials and the cost of case 10 in general.

It will be appreciated that case 10 can be lined or layered with different material or fabric to give case 10 different levels of protection. In an alternative embodiment, the interior of case 10 could be layered with some form of water-proof fabric. Such a configuration would make case 10 both cut-resistant and water-proof, which is good combination for any type of water-related or outdoor activity. A cut-resistant fabric would still form the exterior shell of case 10, but the interior would be lined with a water-proof fabric. Water-proof fabrics are inherently, or have been treated to become, resistant to penetration by water and wetting. They are usually natural or synthetic fabrics that are laminated to or coated with a water-proofing material such as rubber, polyvinyl chloride (PVC), polyurethane, silicone elastomer, or fluoropolymers. Examples include rubberized fabric used in rain jackets and inflatable boats. If case 10 was water-proof, a flotation device may be optionally incorporated into case 10 so that case 10 would be capable of floating.

In another alternative embodiment, the cut-resistant exterior of case 10 can also be layered together with Nomix, a fire-resistant material or any other fire-resistant material that is on the market. This would make case 10 both cut-resistant and fire-resistant. It can even be appreciated that if a third water-proof layer was added, case 10 would become both cut-resistant, fire-resistant and water-proof. Although it is preferred that the cut-resistant fabric form the exterior of case 10, it can be appreciated that the exterior of case 10 can be made from a water-proof fabric or fire-resistant fabric. In this instance, the cut-resistant material would line the interior of case 10. By layering different types of fabric into case 10, case 10 can be specifically tailored to provide protection of objects for all types of different activities.

Lock 12 is preferably a bank bag lock, such as Hudson Lock No. 3535 or 3486, for example. It will be appreciated that other types of locks can be used in alternative embodiments. Both of the Hudson locks have a seven pin tumbler-keyed type of lock and are commercially available. Lock 12 can also be any commercially available lock that is capable of securing pull tab 14 and zipper 16 in a closed position. As shown in FIG. 1, rivet 30 and leather portion 32 securely and firmly holds lock 12 inside the interior of case 10. Although not shown, there are other rivets that securely and firmly hold lock 12 inside of the interior of case 10. It can be appreciated that a piece or pieces of heavy duty plastic or metal could be used instead of leather portion 32 for securing lock 12 inside case 10.

Figure 3:
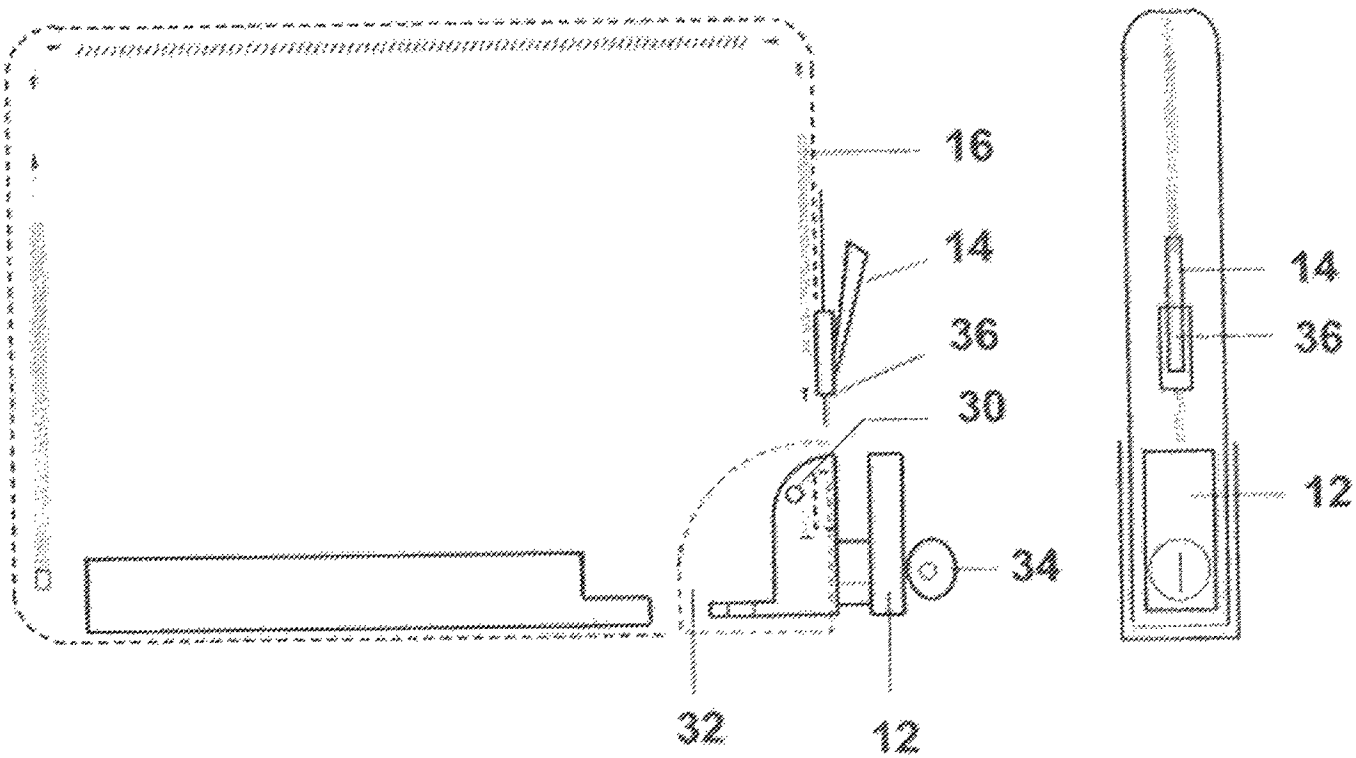
FIG. 3 illustrates the locking mechanism according to an embodiment of the present invention.

FIG. 3 illustrates lock 12 and the parts of zipper 16 in more detail according to an embodiment of the present invention. Lock 12 is opened by inserting key 34 into the body or barrel of lock 12 and turning the key 34. Thereupon, the barrel of the lock 12 is released or pushes out from the closed position, thereby releasing slider 36 and pull tab 14 so they can be pulled along the chain of zipper 16 to open case 10. When closing lock 12, slider 36 and pull tab 14 are inserted into lock 12, whereby the barrel is pushed into the body of lock 12 and the key 34 is turned to lock the barrel into the body. Thus, zipper 16, slider 36 and pull tab 14 are securely held by lock 12.

As shown in FIG. 3, slider 36 and pull tab 14 run along the chain or teeth of zipper 16 to either open or close the zipper, thus opening or closing case 10. The teeth of zipper 16 are sewn into the edge of three sides of case 10. It will be appreciated that in alternative embodiments, zipper 16 can run along one, two, three or four sides of the case, depending on the type of case being made and the intended objects to be stored therein. Cut-resistant threads are used to securely hold the zipper into case 10. Zipper 16 is a cut-resistant zipper that is difficult or substantially impossible to pry apart. Zipper 16 can also be a waterproof zipper. Zipper 16 can be any type of commercially available zipper that is substantially non-breakable and is resistant to being cut or pried open.

When case 10 is closed, lock 12 engages and holds the pull tab 14 and zipper slider 36. The zipper slider 36, which is of a low profile design, (low profile so it fits into the lock) is the device that moves up and down the teeth of the zipper chain to open or close the zipper 16. The pull tab 14 is unable to be moved when lock 12 is in the locked position. Key 34 is preferably used to open lock 12, which when opened, disengages the pull tab 14 and zipper slider 36. The zipper slider 36 then can be pulled along the chain of zipper 16 so that case 10 is opened, making the contents of the case accessible for removal. The chain of the zipper is also made from cut-resistant material.

Returning to FIG. 1, a pair of grommets 18 is sewn into case 10 so that case 10 can be connected to a steel cable and fastened to or around a stationary object (whether movable or immovable). In the preferred embodiment, one grommet 18 is sewn into each side of case 10 as shown in FIG. 2. When the case 10 is folded, the two grommet 18 concentrically align, whereby the holes in each grommet 18 also concentrically align when case 10 is folded or closed. This allows a steel cable to be inserted through the hole of grommets 18. Each grommet 18 can be made of steel or any other durable material. In other embodiments, a single grommet 18 will be sewn into the exterior of case 10, where one part of the grommet 18 is on one side of case 10 and the other, interlocking part of the grommet 18 is on the other side of case 10. In other embodiments, two interlocking grommets 18 can be used, where one grommet 18 will fit into or interlock with the other grommet 18.

Although one pair grommet 18 is used in FIG. 1, it will be appreciated that multiple pairs of grommets 18 can be used in case 10. For example, one pair of grommet 18 could be used for securing case 10 to a stationary object; while a second pair of grommets 18 could be used for securing an object inside case 10. For example, the second pair of grommets 18 could be aligned with the trigger mechanism of a gun so that a separate pin lock could be used to secure the gun inside case 10.

A pair of grommets 18 could be located at any position within case 10, but located so that none of the objects contained inside case 10 are exposed by the holes of grommet 18. For example, when case 10 is used for holding a revolver, the revolver must fit inside case 10 without exposing any portion of the revolver. In another example, when case 10 is used for holding a computer, the computer must fit inside case 10 so that a steel cable could be threaded through the hole formed by grommet 18. In some embodiments, one part of a durable grommet 18 or some other durable plastic or metal ring or loop could be sewn into the exterior shell of case 10 so that a part of the grommet 18 is sticking out from case 10.

Figure 4:
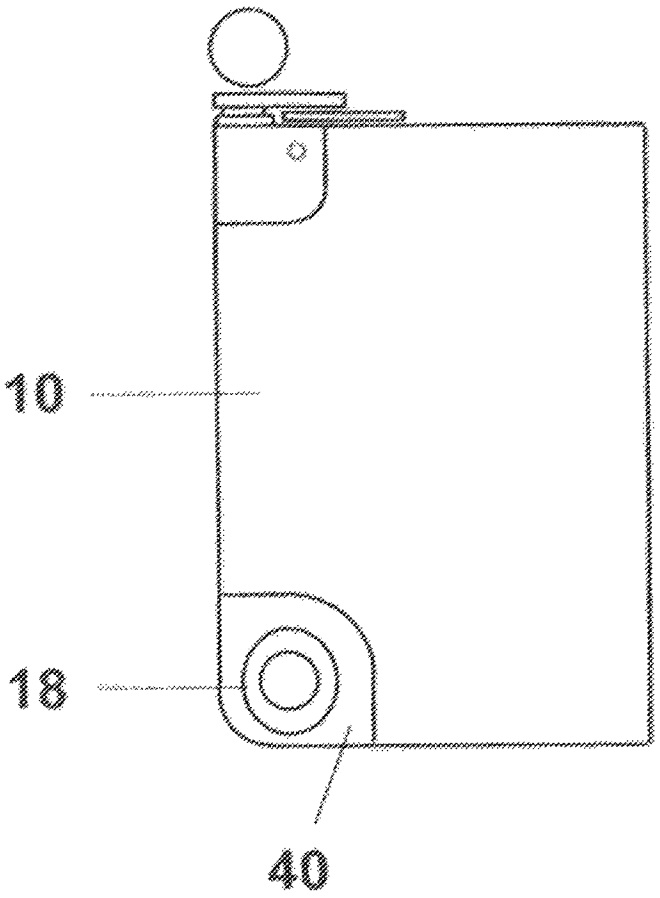
FIG. 4 illustrates a case where a grommet would be formed into a separate compartment according to an alternative embodiment of the present invention.

FIG. 4 illustrates case 10 where grommet 18 would be formed into a separate compartment 40. Alternatively, instead of using grommet 18, a hole could be formed into compartment 40. Compartment 40 would be made from non-breakable, cut-resistant and water-proof type of fabric, plastic or metal. If plastic was used for compartment 40, compartment 40 would be integrally formed with grommet 18. Compartment 40 would be substantially non-breakable. Compartment 40 would be jointed or sewn into case 10 so that case 10 could be fully opened. Compartment 40 that holds grommet or grommets 18 is fully sealed and cannot be individually opened, thus providing extra protection against water leaking into case 10.

Anchoring case 10 to a stationary object greatly deters and prevents the theft of case 10. Attaching case 10 to a stationary object can take many forms. In one example, a steel cable that has a loop at both ends is threaded through the hole formed by the hole of grommet 18 and around the stationary object. The loops of the steel cable are then joined together and locked via a separate lock, for example, a padlock with a key or a combination lock. In another example, a long shackle of pad lock is threaded through the hole of grommet 18 and around case 10 whereby a shackle of a padlock fits through the grommet 18 and the end loop of the cable. The other end of the cable is attached or anchored via a separate locking mechanism to a stationary object, such as a seat or stationary part of a vehicle, train, bus, airplane, boat or any other form of transportation. In another example, a hanger, such as found at a gym, could be inserted through the hole of grommet 18. After insertion, then a lock could be placed at the end of the hanger to hold case 10 to the hanger, thus preventing the theft of case 10.

As shown in FIG. 1, handle 20 on case 10 is made either of the same cut-resistant material as the exterior shell of case 10, or may be made of some type of ballistic nylon or other material. The handle can also be foam-padded. Although it is preferred that handle 20 have a low-profile design, it can be appreciated that all types of handles can be incorporated into case 10. It is preferred to use grommet 18 instead of handle 20 for securing case 10 to a stationary object. However, in alternative embodiments, a cut-resistant handle 20 may be used instead of grommet 18 for securing case 10 to a stationary object.

As shown in FIG. 1, case 10 contains a commercially available GPS transmitter or tracking device 22 in one of the pockets. GPS transmitter 22 can be any of those commercially available, including for example, the Spark Nano by Brickhouse Security or the GTU 10 by Garmin. The GPS transmitter 22 is either sewn into the interior of case 10 or is inserted into the interior of case 10 via Velcro or any other means such a pocket (see FIG. 1), for example. Having GPS transmitter 22 is important for tracking case 10 if it was misplaced or stolen. However, since a thief would be unable to open the case 10, GPS transmitter 22 could be enabled so that that the stolen case could be tracked and retrieved. There are companies that specialize in providing GPS tracking capabilities for objects. Some companies permit one to track their objects via the Internet or via their cell phone.

Alternatively, if case 10 contained a cell phone that had GPS tracking capability, such as the iPhone for example, case 10 could be located using the cell phone's GPS tracking functionality. The GPS tracking device would preferably be non-breakable so it could not be broken or disengaged if a thief tried slamming the case against a hard object in an attempt to disable GPS transmitter 22.

Case 10 may also contain an insert that conforms to and holds a particular item in case 10. The insert may be made of steel, plastic or other durable material that can withstand shock from great force. The insert may be pre-formed or molded into a particular shape and size, or may be configurable in the interior portion of case 10 using a system for making interconnections, such as Velcro for example. For example, case 10 may contain an insert that is formed or molded to hold a gun, revolver or pistol in a certain and unmovable position inside case 10. This is important so that the gun does not move, thus preventing the trigger mechanism from becoming engaged so that the gun is not discharged. In another example, an insert may be formed to hold a number of watches or rings. In another example, an insert may be formed to hold a computer in one location inside case, and a cell phone in another location inside case.

Figure 5:
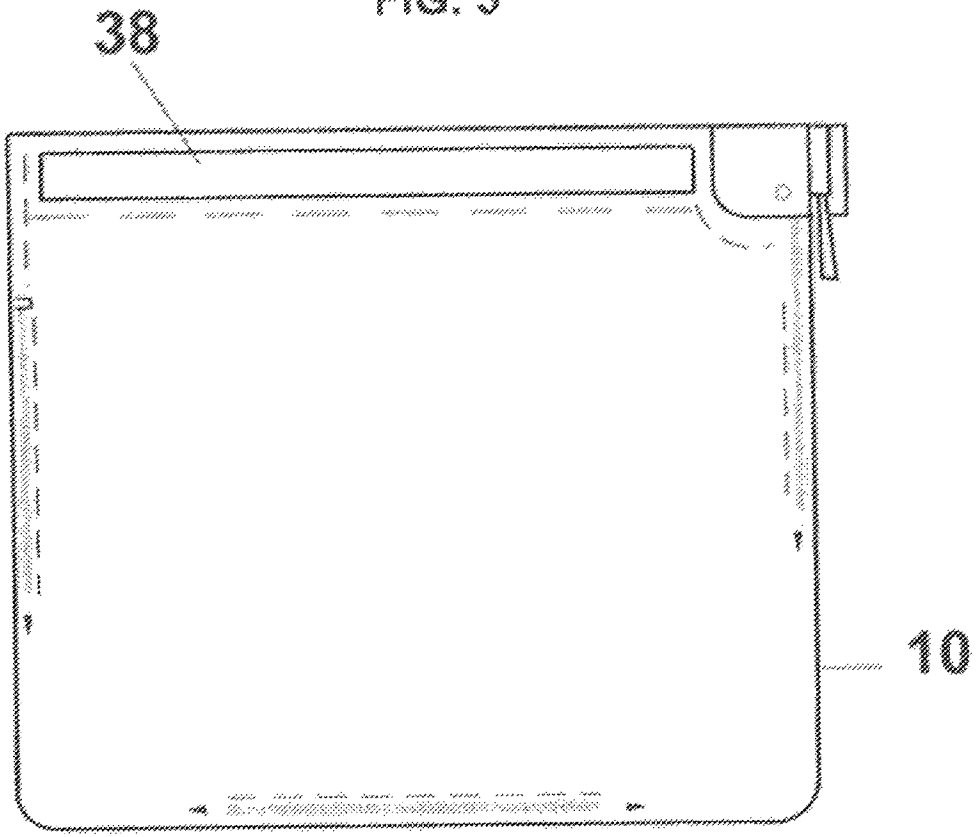
FIG. 5 illustrates a case that contains a non-breakable handle according to an alternative embodiment of the present invention.

FIG. 5 illustrates case 10 that contains a different handle 38 according to an alternative embodiment of the present invention. The handle 38 is configured in a rectangular fashion as shown in FIG. 4, although other shapes and dimensions of the handle could be used as well. The inside portion of handle 38 can be made smaller than that shown in FIG. 5. Handle 38 can be made from steel, metal, PVC, plastic, or some other non-breakable, durable material. In this configuration, grommet 18 is unnecessary, since handle 38 could be used for securing case 10 to a stationary object via a steel cable.

Figure 6:
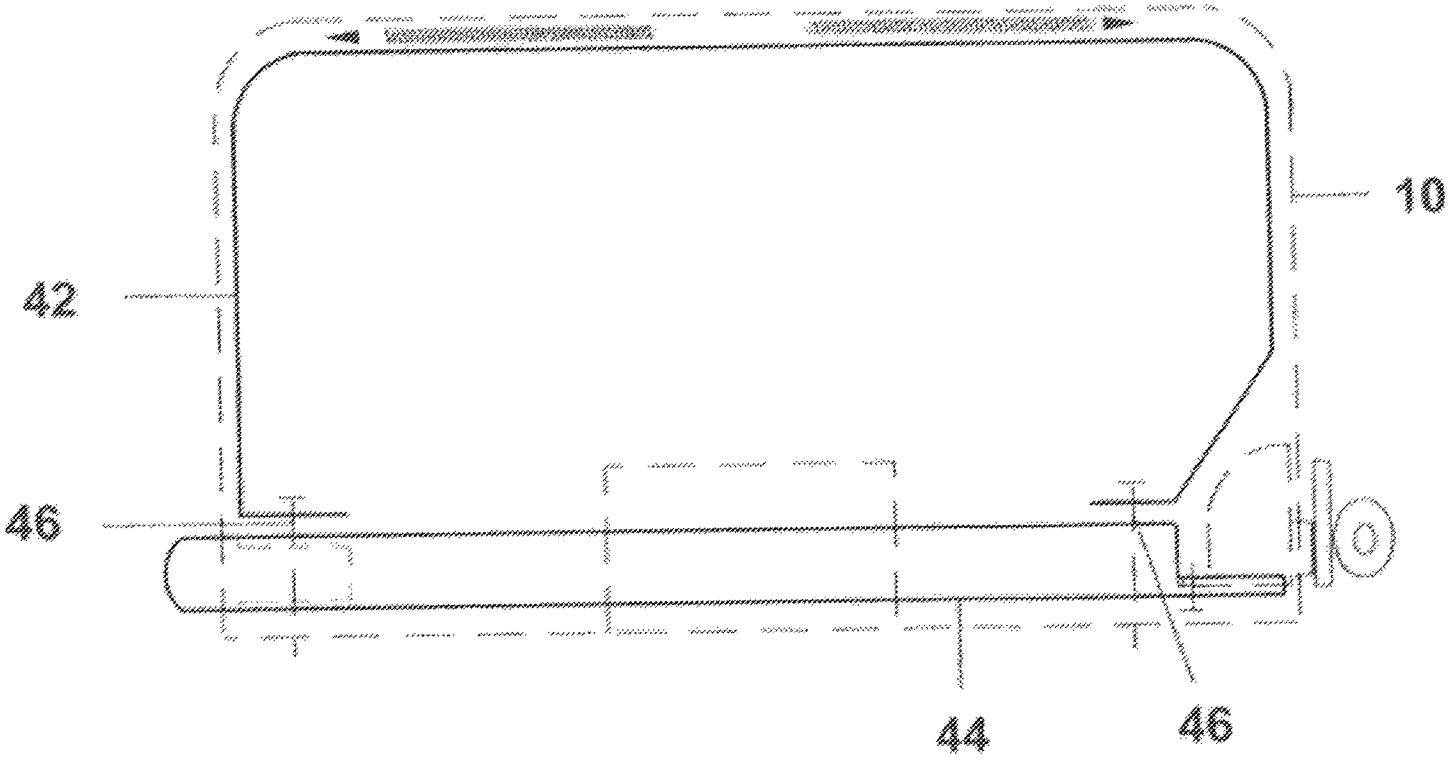
FIG. 6 illustrates a case that has frame that goes around an interior circumference of the case according to an alternative embodiment of the present invention.

FIG. 6 shows case 10 that has frame 42 that goes around the interior circumference of case 10. Frame 42 is underneath zipper 16 and sewn between a cut-resistant exterior layer and a padded or nylon interior layer. Frame 42 is riveted onto hollow tubing 44 using rivet-welds 46. Frame 42 and hollow tubing 44 are preferably made of steel, but could be made of any other durable material such as metal, plastic or PVC piping, for example. By having a more rigid case 10, case 10 could be used as a shield or weapon, for example, when case 10 was unable to be opened during a struggle with a thief.

Figure 7:
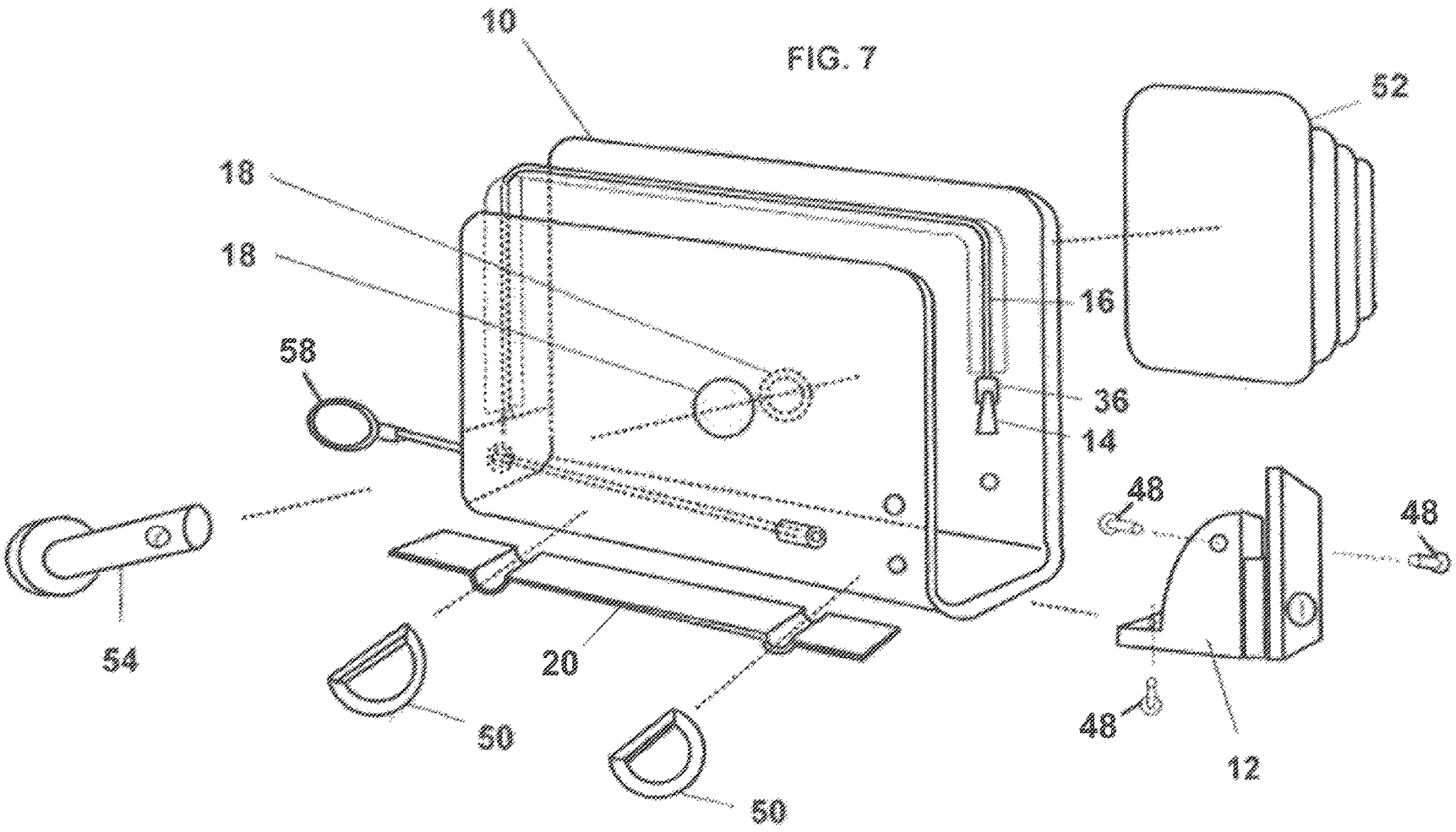
FIG. 7 illustrates a perspective view of a case according to an embodiment of the present invention.

FIG. 7 illustrates a perspective view of case 10 according to an embodiment of the present invention. As shown in FIG. 7, case 10 has lock 12, pull tab 14, zipper 16, a pair of grommets 18, a low-profile handle 20 and slider 36. Lock 12 is securely fastened to case 10 via rivets 48. A rivet 48 is attached to each side and to the bottom of lock 12. Handle 20 has a two loops 50, attached to both ends of handle 20. Loops 50 are made from plastic or metal, and are used for attaching to a buckle for expanding the handle or to make a strap for carrying case 10.

FIG. 7 also illustrates that the body 11 of case 10 comprises layers 52 of material and/or fabric. Layers 52 can comprise layers of different combinations fabric or material, including layers of the same material or fabric. For example, layers 52 can comprise an exterior cut-resistant fabric layer 13, followed by a fire-resistant or water-proof layer 70, followed padding 72 and lastly a nylon 74, interior layer 74 or lining 74 of case 10. Although cut-resistant fabric layer 11 is preferably on the exterior of case 10, it can be appreciated that the exterior layer be a different layer other than cut-resistant fabric 11. Also, layers 52 can have multiple layers of the same fabric, meaning that two layers of cut-resistant fabric could be used instead of using a single layer of cut-resistant fabric.

Figure 8:
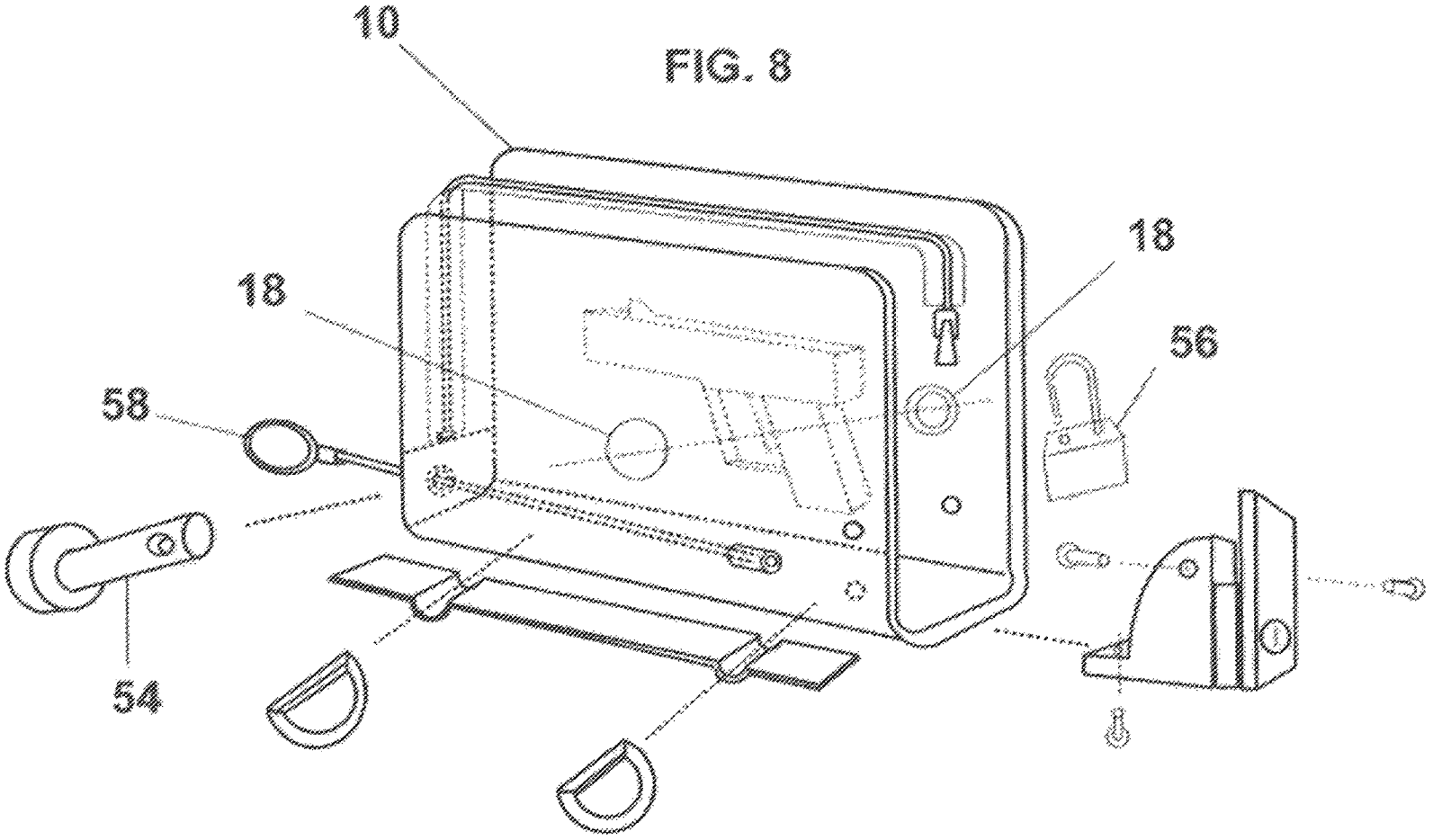
FIG. 8 illustrates a perspective view of a case for securely holding a gun according to an embodiment of the present invention.

FIG. 7 also illustrates locking pin 54 and that the pair of grommets 18 are located in the center of case 10. Locking pin 54 is made of steel, metal or non-breakable plastic. For this particular configuration, locking pin 54 can be inserted through the hole of the concentrically aligned grommets 18. As shown in FIG. 7, the end piece of locking pin 54 is larger than the hole of the grommets 18. When locking pin 54 is inserted into the grommet hole, the end piece will stop at one side of case 10. On the other side of case 10, a separate lock can be inserted through the hole of locking pin 54 so as to securely fasten locking pin 54 to case 10. This is illustrated in more detail in FIG. 8, where locking pin 54 is insertable into grommet 18, through the trigger mechanism of a revolver or gun, through the opposite grommet 18 and then locked via lock 56 through the hole of locking pin 54. This configuration locks a gun into case 10. If a thief would steal case 10, the thief could not get the gun due to the exterior being cut-resistant and the locking pin 54 and lock 56 being virtually non-breakable.

Also illustrated in FIG. 7 is steel cable 58 having a loop at one end and a crimp at the other. Steel cable 58 is used for securing case 10 to a stationary object. Steel cable 58 is threaded or fits through a grommet on the side of case 10. When not in use, steel cable 58 is pushed into case 10, and is stored inside the interior of case 10. The loop of the steel cable 58 is preferably unable to be pushed inside case 10. Steel cable 58 can be extended and secured to a stationary object instead of inserting a steel cable through grommets 18 and securing the steel cable to a stationary object. The crimp at the end of steel cable 58 would prevent the removal of steel cable 58 from case 10. It can be appreciated that steel cable 10 could comprise an automatically retractable steel cable. Also, a separate compartment could be made in the interior of case 10 for housing steel cable 58.

Figure 9:
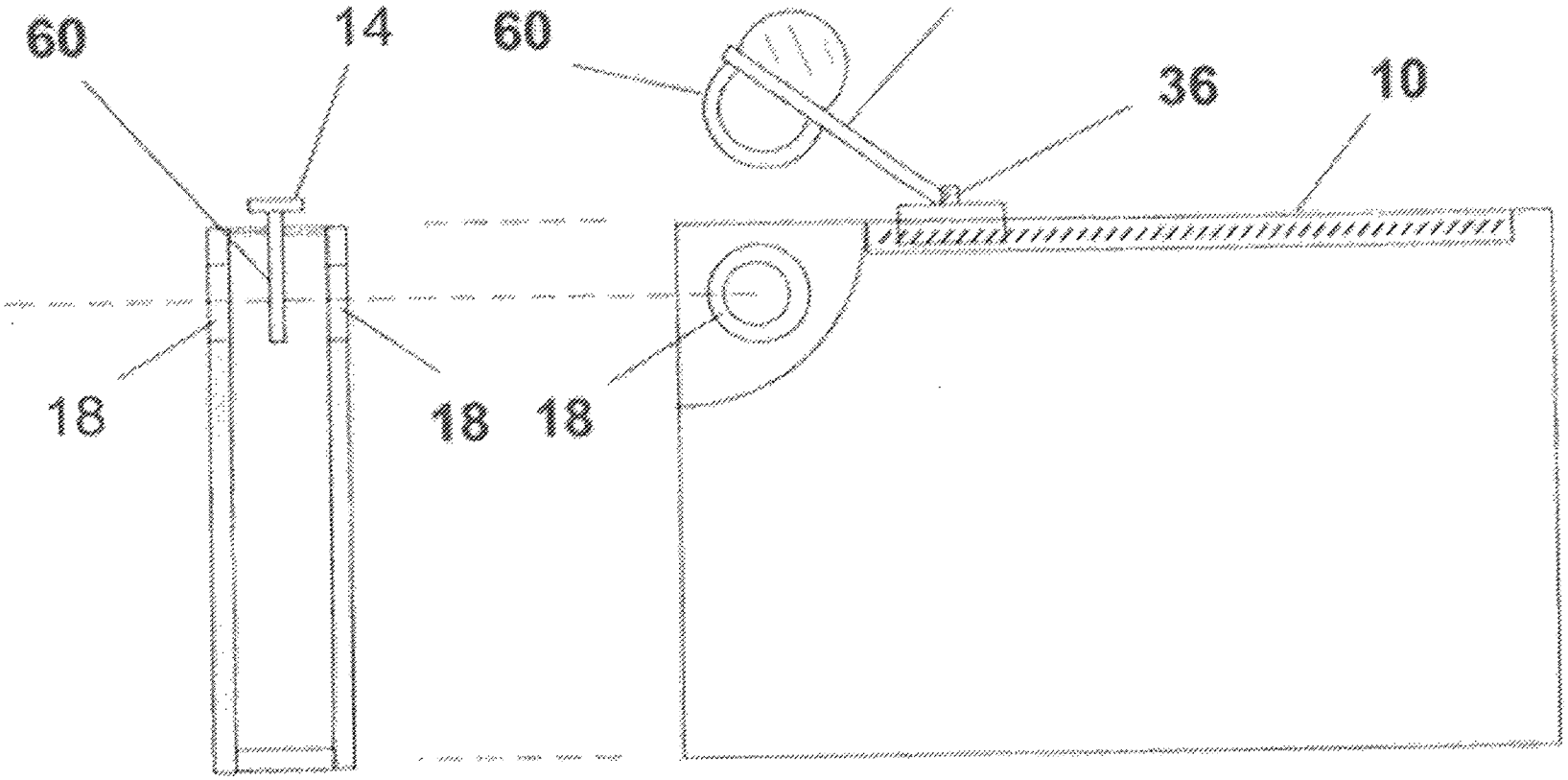
FIG. 9 illustrates another mechanism for locking a case according to an alternative embodiment of the present invention.

FIG. 9 illustrates another mechanism for locking case 10 according to an alternative embodiment of the present invention. Pull tab 14 is connected to slider 36. A pair of grommets 18 are located on both sides of the exterior shell of case 10. Loop 58, either made of steel, durable metal or non-breakable plastic is attached to or integrally formed with pull tab 14. Part of pull tab 14 can be inserted into case 10, whereby the hole of loop 58 aligns with the hole formed by grommets 18. Through this hole, a steel cable and/or lock can be inserted, thus preventing pull tab 14 to be pulled and zipper 16 of case 10 opened. This configuration eliminates the need for lock 12, because a single lock can be used for securely holding pull tab 14 and a steel cable.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A case comprising:

a body formed of ultra-high molecular weight polyethylene, the body having a front, a back, a top, a bottom, and two sides;

a zipper having a pull tab for fastening opposing edges of the body to enable complete closure of the body along the top of the body;

a lock located at one end of the zipper, the lock being able to securely hold the zipper and pull tab when in a locked position;

a first ring fastened to the front of the body, where a center of the first ring is located halfway along a length of the front of the body and halfway along a height of the front of the body;

a second ring fastened to the back of the body, where a center of the second ring is located halfway along the length of the back of the body and halfway along the height of the back of the body;

an opening of the first ring and an opening of the second ring being configured to concentrically align when the zipper and the pull tab are in a locked position;

a cable having a loop at one end and a crimp at another end, the crimp being located inside the case;

a third ring connected on the body, wherein the steel cable goes through the third ring; and a locking pin, where one end of the locking pin is larger than an opening formed by the pair of rings, and wherein the locking pin is configured to be inserted into the opening, and wherein the locking pin has a hole at an end of the locking pin that is inserted into the opening.

2. The case of claim 1, wherein the locking pin is configured to be inserted through a trigger guard of a gun.

* * * * *